US011749942B2

(12) United States Patent
Yang

(10) Patent No.: US 11,749,942 B2
(45) Date of Patent: Sep. 5, 2023

(54) MAGNETIC CONNECTOR AND METHOD OF MANUFACTURING MAGNETIC CONNECTOR

(71) Applicant: Cheng Uei Precision Industry Co., LTD., New Taipei (TW)

(72) Inventor: Yu-Lin Yang, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 148 days.

(21) Appl. No.: 17/489,766

(22) Filed: Sep. 29, 2021

(65) Prior Publication Data

US 2023/0041436 A1 Feb. 9, 2023

(30) Foreign Application Priority Data

Aug. 5, 2021 (CN) ..... 202121822227.6

(51) Int. Cl.
*H01R 13/62* (2006.01)
*H01R 43/20* (2006.01)
*H01R 13/502* (2006.01)
*H01R 13/66* (2006.01)

(52) U.S. Cl.
CPC ..... *H01R 13/6205* (2013.01); *H01R 13/502* (2013.01); *H01R 43/205* (2013.01); *H01R 13/6616* (2013.01)

(58) Field of Classification Search
CPC ..... H01R 13/6205; H01R 13/502; H01R 13/6616; H01R 43/205; H01R 11/30
USPC ..... 439/38–40
See application file for complete search history.

(56) References Cited

U.S. PATENT DOCUMENTS

2013/0273752 A1* 10/2013 Rudisill ..... H01R 13/6205 439/39
2015/0093920 A1* 4/2015 Colantuono ..... H01R 13/6205 439/39
2015/0188253 A1* 7/2015 Tada ..... H01R 13/6205 439/39
2016/0111815 A1* 4/2016 Szeto ..... H01R 43/16 439/39

FOREIGN PATENT DOCUMENTS

TW I554165 B 10/2016

* cited by examiner

*Primary Examiner* — Gary F Paumen
(74) *Attorney, Agent, or Firm* — Cheng-Ju Chiang

(57) ABSTRACT

A magnetic connector includes a first insulating housing, a printed circuit board, a plurality of magnetic bodies, a plurality of terminals and a second insulating housing. The first insulating housing has a bottom wall, a side wall, a recess being defined between the bottom wall and the side wall. The printed circuit board is received in the recess. The magnetic bodies are mounted to the printed circuit board. The terminals are mounted to the printed circuit board. The second insulating housing is mounted to the top of the first insulating housing and is covered the recess. The magnetic bodies and the terminals are exposed from a top surface of the second insulating housing. As described above, the magnetic bodies are mounted to the printed circuit board, and then the magnetic bodies are magnetized. Hence, manufacture cost of the magnetic connector is saved.

20 Claims, 7 Drawing Sheets

MAGNETIC CONNECTOR AND METHOD OF MANUFACTURING MAGNETIC CONNECTOR

CROSS-REFERENCE TO RELATED APPLICATION

The present application is based on, and claims priority from, China Patent Application No. 202121822227.6, filed Aug. 5, 2021, the disclosure of which is hereby incorporated by reference herein in its entirety.

BACKGROUND OF THE INVENTION

1. Field of the Invention

The present invention generally relates to a connector, and more particularly to a magnetic connector.

2. The Related Art

According to progress of electrical technology, magnetic connectors are the most widely applied connectors. Magnetic connectors have been widely applied in the various consumer products such as mobile phone, medical device, etc.

Referring to FIG. 7, a conventional magnetic connector includes a printed circuit board 20' and magnetic bodies 30' being independent from the printed circuit board 20'. In the production of the conventional magnetic connector, terminals 40' are soldered on the printed circuit board 20' by a surface mount technology, and then the printed circuit board 20' together with the terminals 40' are assembled in an insulating housing. Finally, the magnetic bodies 30' are assembled in the insulating housing respectively. Hence, a plurality of position structures are designed in an inside of the insulating housing for holding the printed circuit board 20' and the magnetic bodies 30', and the magnetic bodies 30' also need to be fixed in the insulating housing by adhesives. The Taiwan Patent Publication No. 1554165 discloses a conventional magnetic connector having a printed circuit board and magnetic bodies fixed in the insulating housing separately.

However, the conventional magnetic connector needs to differentiate the magnetic pole of the magnetic bodies 30' in advance, and then the magnetic bodies 30' are assembled in predetermination positions of the insulating housing according to the magnetic pole of the magnetic bodies 30'. Furthermore, before assembling the magnetic bodies 30', the printed circuit board 20' needs to be assembled in the insulating housing. Hence, structure and manufacturing processes of the conventional magnetic connector are complicated.

SUMMARY OF THE INVENTION

An object of the present invention is to provide a magnetic connector. The magnetic connector includes a first insulating housing, a printed circuit board, a plurality of magnetic bodies, a plurality of terminals and a second insulating housing. The first insulating housing has a bottom wall, a side wall, a recess being defined between the bottom wall and the side wall, the recess is opened at a top of the first insulating housing. The printed circuit board is received in the recess. The magnetic bodies are mounted to the printed circuit board. The terminals are mounted to the printed circuit board. The terminals are located between the magnetic bodies. The second insulating housing is mounted to the top of the first insulating housing and is covered the recess. The magnetic bodies and the terminals are exposed from a top surface of the second insulating housing. Each of the magnetic bodies is without magnetic pole before the magnetic bodies are mounted to the printed circuit board. Each of the magnetic bodies has a predetermination magnetic pole by magnetizing the magnetic bodies after the magnetic bodies are mounted to the printed circuit board.

Another object of the present invention is to provide a manufacturing method of a magnetic connector. The method of manufacturing the magnetic connector comprises steps of: providing a first insulating housing and a second insulating housing; mounting a plurality of magnetic bodies and a plurality of terminals on pads of a printed circuit board; soldering the magnetic bodies and the terminals on the printed circuit board, and the magnetic bodies being without magnetic pole at this time; magnetizing the magnetic bodies to have predetermination magnetic poles after the soldering step; assembling the printed circuit board with the magnetic bodies and the terminals into a recess of the first insulating housing; and assembling the second insulating housing to the first insulating housing to cover the recess.

Another object of the present invention is to provide a manufacturing method of a magnetic connector. The method of manufacturing the magnetic connector comprises steps of: providing a first insulating housing and a second insulating housing; mounting a plurality of magnetic bodies and a plurality of terminals on pads of a printed circuit board; soldering the magnetic bodies and the terminals on the printed circuit board, and the magnetic bodies being without magnetic pole at this time; assembling the printed circuit board with the magnetic bodies and the terminals into a recess of the first insulating housing; magnetizing the magnetic bodies to have predetermination magnetic poles; and assembling the second insulating housing to the first insulating housing to cover the recess.

As described above, the terminals and the magnetic bodies are together soldered on the printed circuit board by a surface mount technology, and then the magnetic bodies are magnetized after the soldering step. So that the magnetic pole differentiating process in the prior art is omitted, and the assembling process and the gluing process of the magnetic bodies in the prior art are further avoid. As a result, comparing with the conventional magnetic connector, the magnetic connector of the present invention has fewer manufacturing steps and simple structure. Hence, manufacture efficiency of the magnetic connector is improved, and manufacture cost of the magnetic connector is saved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
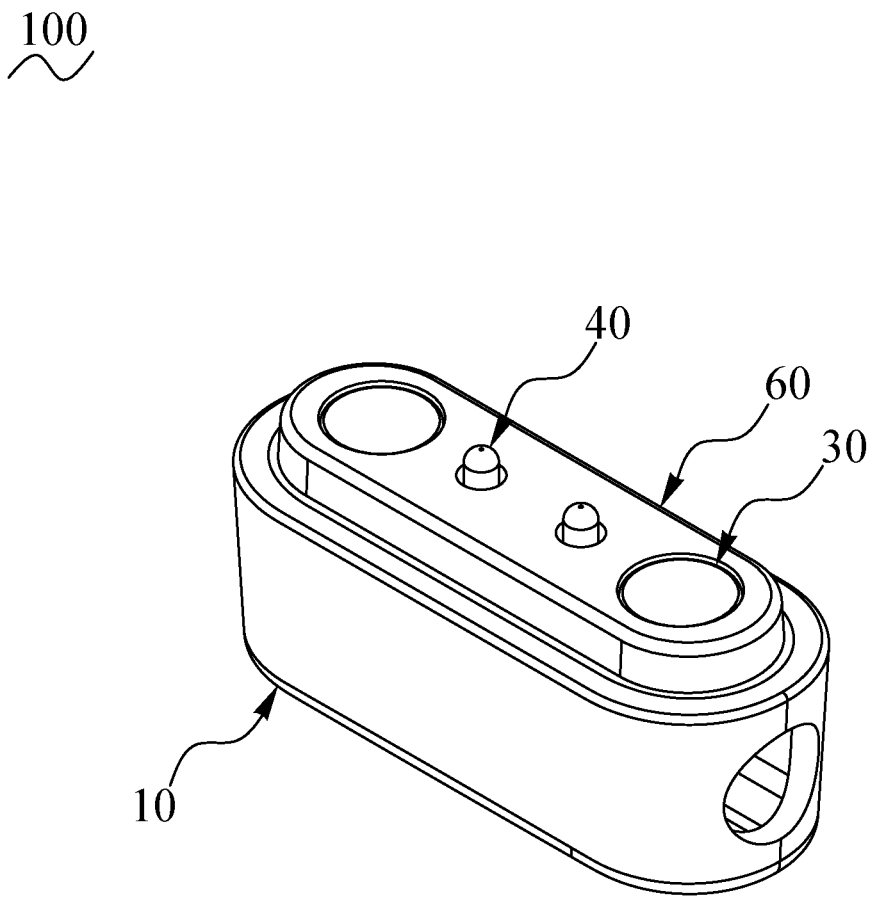
FIG. 1 is a perspective view of a magnetic connector in accordance with a preferred embodiment of the present invention.
Figure 2:
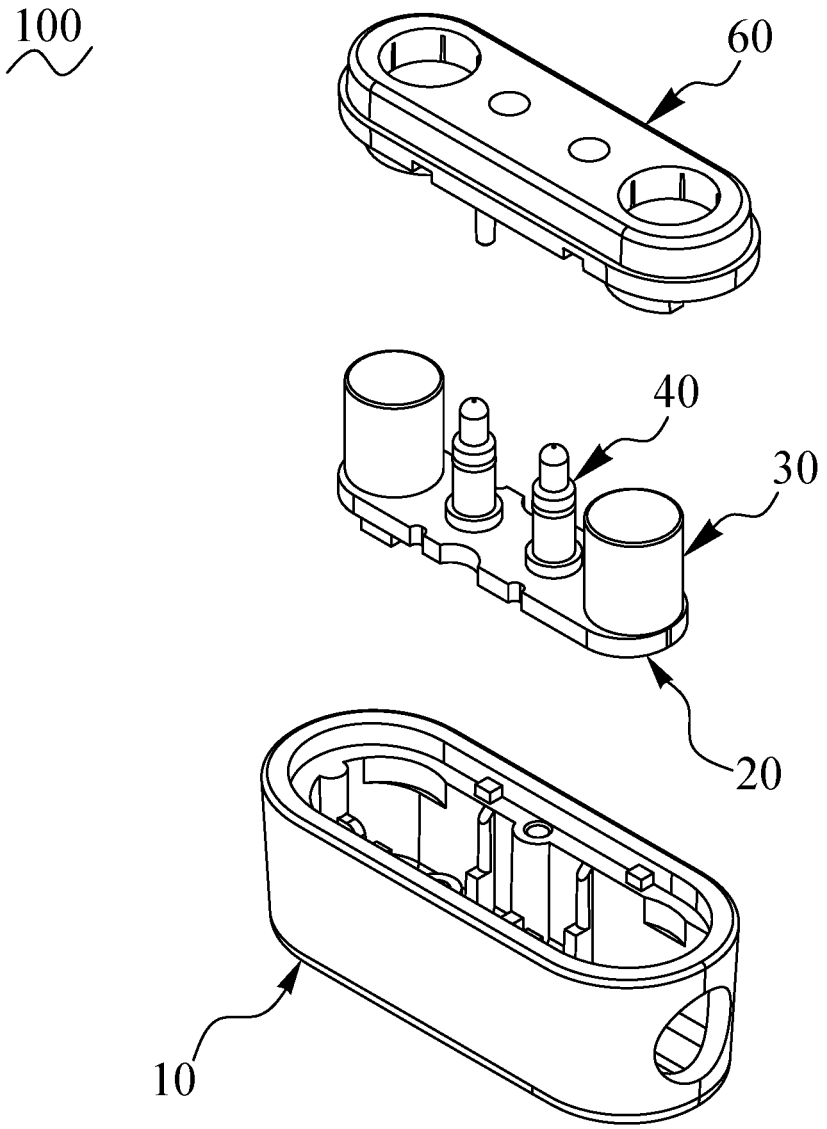
FIG. 2 is an exploded view of the magnetic connector of FIG. 1.

With reference to FIG. 1 and FIG. 2, a magnetic connector 100 in accordance with a preferred embodiment of the present invention is shown. The magnetic connector 100 includes a first insulating housing 10, a printed circuit board 20, a plurality of magnetic bodies 30, a plurality of terminals 40 and a second insulating housing 60.

Figure 3:
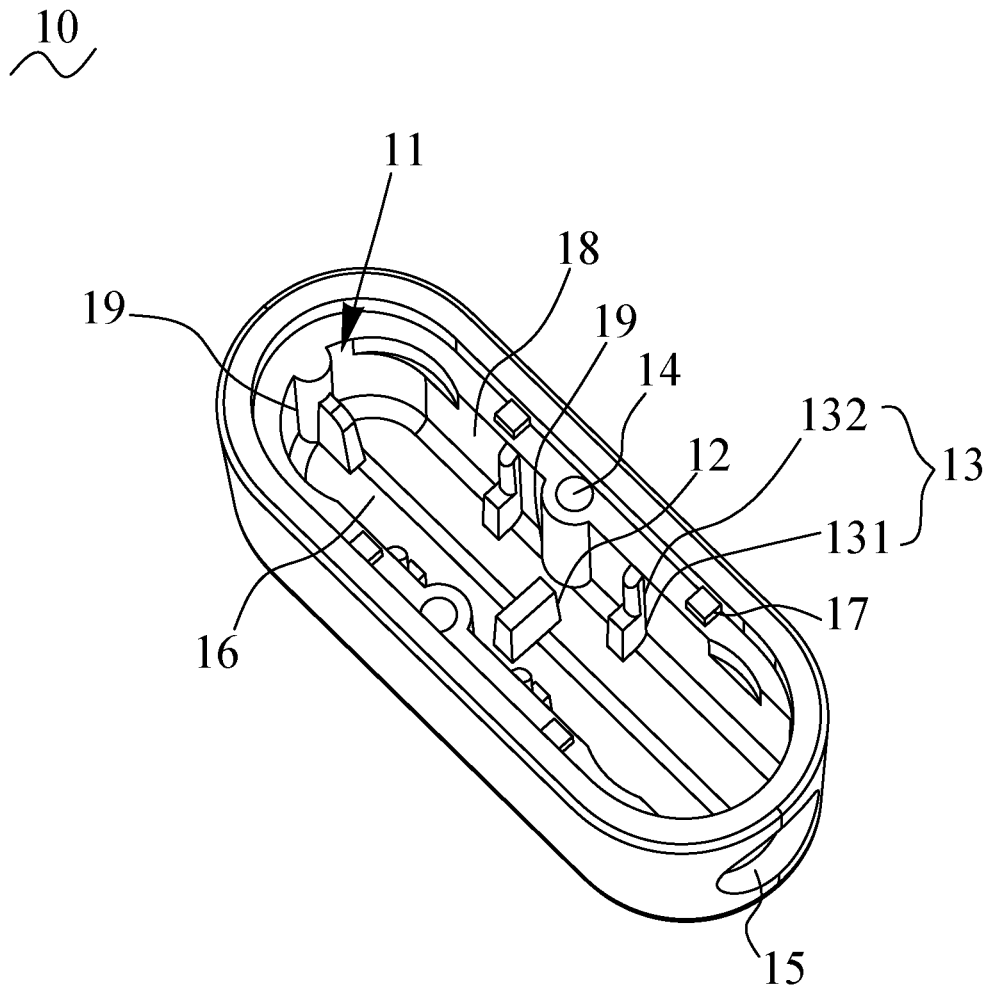
FIG. 3 is a perspective view of a first insulating housing in accordance with the preferred embodiment of the present invention.

Referring to FIG. 2 and FIG. 3, the first insulating housing 10 has a bottom wall 16 and a side wall 18. A recess 11 is defined between the bottom wall 16 and the side wall 18, and the recess 11 is opened at a top of the first insulating housing 10. A first supporting portion 12 is extended upward from a middle of an inner surface of the bottom wall 16, and the first supporting portion 12 is positioned in the recess 11. In this case, the first supporting portion 12 is rectangular shape. A plurality of protruding portions 13 are extended upward from a peripheral of the inner surface of the bottom wall 16, and the protruding portions 13 are positioned in the recess 11. In this case, each of the protruding portions 13 is step shape. In the preferred embodiment, each of the protruding portions 13 has a second supporting portion 131 extended upward from the inner surface of the bottom wall 16 and a first positioning portion 132 extended upward from a top surface of the second supporting portion 131. In the preferred embodiment, the side wall 18 includes opposite long walls and opposite short walls connected between the long walls. Each of the short walls is arc shape. One of the short walls has a perforation 15 penetrating through the short wall, and a cable (not shown) is passed through the perforation 15 for connecting to the printed circuit board 20.

A plurality of alignment portions 19 are extended upward from the peripheral of the inner surface of the bottom wall 16, each of inner surfaces of the long walls of the side wall 18 has one alignment portion 19, and an inner surface of the other short wall of the side wall 18 also has one alignment portion 19. The alignment portions 19 guide the printed circuit board 20 to be assembled in the recess 11 of the first housing 10 and ensure that the printed circuit board 20 is assembled in the recess 11 of the first housing 10 in a correct direction. In the preferred embodiment, each of the alignment portions 19 is located between two protruding portions 13. In the preferred embodiment, a top surface of each long wall of the side wall 18 is formed a docking groove 14, the docking groove 14 is perpendicular to the bottom wall 16. In this case, the docking groove 14 is a tubular shape. The docking groove 14 is formed in the alignment portion 19 of each long wall. A plurality of bumps 17 are extended upward from the top surface of each long wall of the side wall 18.

Figure 4:
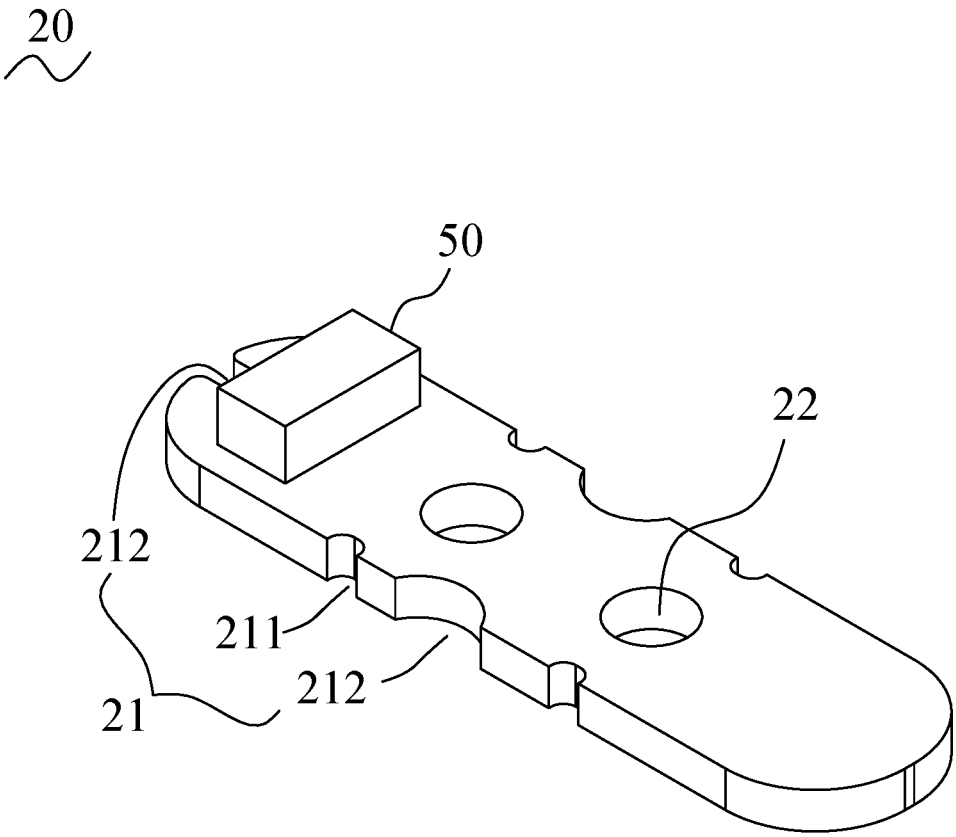
FIG. 4 is a bottom view of a printed circuit board in accordance with the preferred embodiment of the present invention.

With reference to FIG. 2 and FIG. 4, the printed circuit board 20 is positioned in the recess 11 of the first insulating housing 10 and is supported by the first supporting portion 12. A limiting portion 21 is recessed inward from a peripheral of the printed circuit board 20. In the preferred embodiment, the limiting portion 21 includes a plurality of first limiting portions 211 and a plurality of second limiting portions 212. The first limiting portions 211 and the second limiting portions 212 are formed as notches for being engaged with the alignment portions 19 and the first positioning portions 132 of the protruding portions 13. So that the printed circuit board 20 is guided and positioned into the recess 11 of the first insulating housing 10. The first limiting portions 211 are engaged with the first positioning portions 132 of the protruding portions 13 respectively. The second limiting portions 212 are engaged with the alignment portions 19 respectively. A middle of a bottom surface of the printed circuit board 20 is supported by the first supporting portion 12. A peripheral of the bottom surface of the printed circuit board 20 is supported by the second supporting portion 131 of the protruding portions 13. The peripheral of the bottom surface of the printed circuit board 20 are also supported by a lower portion of the alignment portions 19. One of the second limiting portions 212 is engaged with an upper portion of the alignment portion 19 which is formed at the inner surface of the short wall. The printed circuit board 20 has a plurality of insertion holes 22. In the preferred embodiment, each of the insertion holes 22 is a circular shape, and the insertion holes 22 are arranged in a row. A quantity of the insertion holes 22 of the printed circuit board 20 is two.

With reference to FIG. 2, the magnetic bodies 30 are located on a top surface of the printed circuit board 20. In the preferred embodiment, a quantity of the magnetic bodies 30 is two. The magnetic bodies 30 are permanent magnet. A pad (not shown) is disposed on each of opposite ends of the top surface of the printed circuit board 20. The magnetic bodies 30 are respectively soldered on the pads of the top surface of the printed circuit board 20 by a surface mount technology. In the preferred embodiment, the magnetic bodies 30 are without magnetic pole before the magnetic bodies 30 are located on the printed circuit board 20, and each of the magnetic bodies 30 is magnetized to have a predetermination magnetic pole after the magnetic bodies 30 are located on the printed circuit board 20. The magnetic bodies 30 are magnetized by constant current magnetization or pulsed magnetization.

Figure 5:
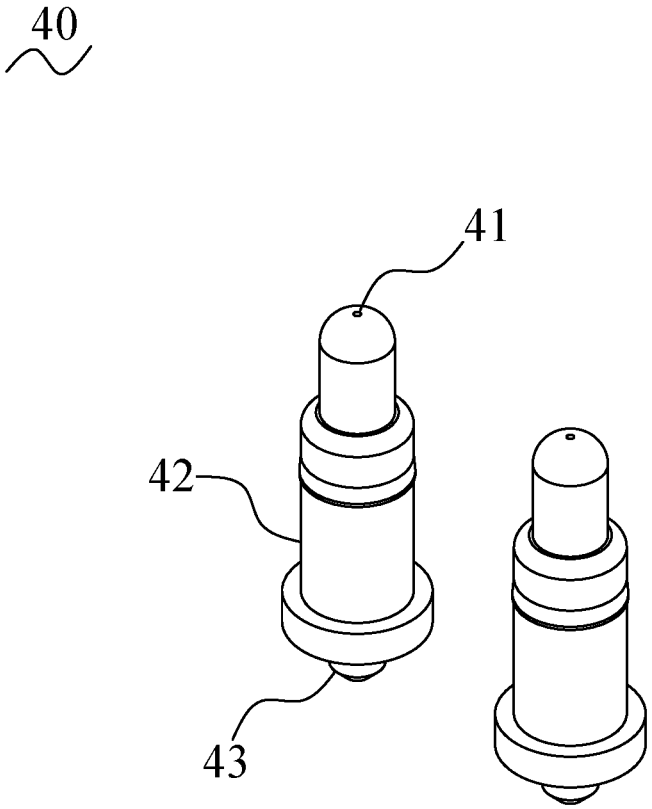
FIG. 5 is a perspective view of a plurality of terminals in accordance with the preferred embodiment of the present invention.

With reference to FIG. 2 and FIG. 5, the terminals 40 are arranged into the insertion holes 22 and are located between the magnetic bodies 30. The terminals 40 are mounted on the top surface of the printed circuit board 20. In the preferred embodiment, the terminals 40 are pogo pins, and a quantity of the pogo pins 40 is two. In detail, each of the pogo pins 40 includes a contact portion 41, a base portion 42 and a soldering portion 43. The contact portion 41 is arranged at one end of the base portion 42, and the soldering portion 43 is arranged at the other end of the base portion 42. The base portion 42 is located at a peripheral of the insertion hole 22 of the printed circuit board 20. The soldering portion 43 is inserted in the insertion hole 22. In a concrete implementation, the terminals 40 are not limited to pogo pins. The terminals 40 can be conductive spring, conductive coil, conductive piece or conductive pillar. The insertion holes 22 of the printed circuit board 20 can also be replaced by pads. The soldering portions 43 of the terminals 40 can be soldered on the pads.

With reference to FIG. 4, in the preferred embodiment, the magnetic connector 100 further comprises a circuit protection element 50. The circuit protection element 50 is soldered on the bottom surface of the printed circuit board 20. The circuit protection element 50 is a thermistor.

Figure 6:
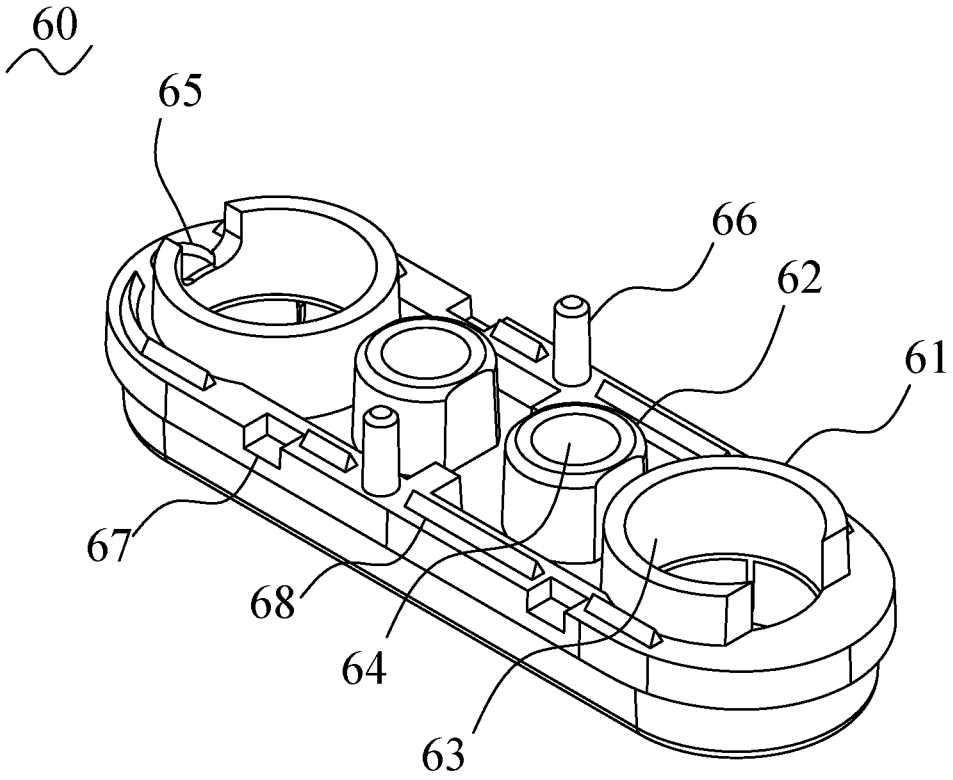
FIG. 6 is a perspective view of a second insulating housing in accordance with the preferred embodiment of the present invention.
Figure 7:
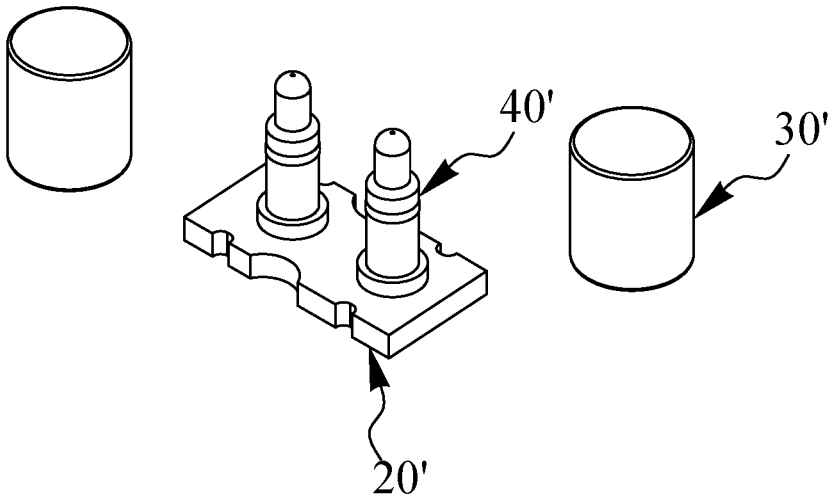
FIG. 7 (Prior Art)
FIG. 7 is a perspective view of a printed circuit board, a plurality of terminals and a plurality of magnetic bodies of a conventional magnetic connector.

With reference to FIG. 2 and FIG. 6, the second insulating housing 60 is arranged on the top of the first insulating housing 10 and covers the recess 11. The second insulating housing 60 has a plurality of first holding portions 61 and a plurality of second holding portions 62 arranged in a row. Each of the first holding portions 61 and the second holding portions 62 is a tubular shape. The first holding portions 61 and the second holding portions 62 are extended inward from a bottom surface of the second insulating housing 60 and are extended into the recess 11. Each of the first holding portions 61 has a first hole 63, and each of the second holding portions 62 has a second hole 64. In the preferred embodiment, the first hole 63 and the second hole 64 are respectively penetrated the first holding portion 61 and the second holding portion 62 from a bottom to a top thereof. One end of the first hole 63 and one end of the second hole 64 are penetrated a top surface of the second insulating housing 60. The other end of the first hole 63 and the other end of the second hole 64 are communicated with the recess 11. The magnetic bodies 30 and the terminals 40 are arranged in the first holes 63 and the second holes 64 respectively. The base portions 42 of the terminals 40 are inserted in the second holes 64. The contact portions 41 of the terminals 40 are extended outward from the second holes 64 and are protruded beyond the top surface of the second insulating housing 60. The magnetic bodies 30 are exposed outside the top surface of the second insulating housing 60. A side of the first holding portion 61 has a notch 65 for receiving the alignment portion 19 of the short wall of the side wall 18 of the first insulating housing 10.

In the preferred embodiment, a plurality of docking portions 66 are corresponding to the docking grooves 14 of the first insulating housing 10. The docking portions 66 are extended downward from a peripheral of the bottom surface of the second insulating housing 60. The docking portions 66 are inserted into the docking grooves 14. A plurality of receiving grooves 67 are corresponding to the bumps 17 of the first insulating housing 10. The receiving grooves 67 are formed at the peripheral of the bottom surface of the second insulating housing 60. The bumps 17 are engaged with the receiving grooves 67. A plurality of welding portions 68 are disposed on the peripheral of the bottom surface of the second insulating housing 60. When the second insulating housing 60 is assembled to the first insulating housing 10, the welding portions 68 are melted by means of an ultrasonic welding technology, so that the second insulating housing 60 is adhered to the first insulating housing 10. As the structure described above, the second insulating housing 60 is able to be aligned with and stably assembled to the top of the first insulating housing 10.

A method of manufacturing the magnetic connector 100 comprises steps of: providing the first insulating housing 10 and the second insulating housing 60 in advance; mounting the magnetic bodies 30, the terminals 40 and the circuit protection element 50 on the pads of the printed circuit board 20; soldering the magnetic bodies 30, the terminals 40 and the circuit protection element 50 on the printed circuit board 20 through a surface mount technology, and the magnetic bodies 30 being without magnetic pole at this time; magnetizing the magnetic bodies 30 to have the predetermination magnetic pole after the soldering step; assembling the printed circuit board 20 with the magnetic bodies 30, the terminals 40 and the circuit protection element 50 into the recess 11 of the first insulating housing 10; assembling the second insulating housing 60 to the first insulating housing 10 by means of an ultrasonic welding technology.

Another method of manufacturing the magnetic connector 100 comprises steps of: providing the first insulating housing 10 and the second insulating housing 60 in advance; mounting the magnetic bodies 30, the terminals 40 and the circuit protection element 50 on the pads of the printed circuit board 20; soldering the magnetic bodies 30, the terminals 40 and the circuit protection element 50 on the printed circuit board 20 through a surface mount technology, and the magnetic bodies 30 being without magnetic pole at this time; assembling the printed circuit board 20 with the magnetic bodies 30, the terminals 40 and the circuit protection element 50 into the recess 11 of the first insulating housing 10; magnetizing the magnetic bodies 30 to have the predetermination magnetic pole; assembling the second insulating housing 60 to the first insulating housing 10 by means of an ultrasonic welding technology.

As described above, the terminals 40 and the magnetic bodies 30 are together soldered on the printed circuit board 20 by a surface mount technology, and then the magnetic bodies 30 are magnetized after the soldering step. So that the magnetic pole differentiating process in the prior art is omitted, and the assembling process and the gluing process of the magnetic bodies in the prior art are further avoid. As a result, comparing with the conventional magnetic connector, the magnetic connector 100 of the present invention has fewer manufacturing steps and simple structure. Hence, manufacture efficiency of the magnetic connector 100 is improved, and manufacture cost of the magnetic connector 100 is saved.

What is claimed is:

1. A magnetic connector, comprising:

a first insulating housing having a bottom wall, a side wall, a recess being defined between the bottom wall and the side wall, the recess being opened at a top of the first insulating housing;

a printed circuit board received in the recess;

a plurality of magnetic bodies mounted to the printed circuit board;

a plurality of terminals mounted to the printed circuit board, the terminals being located between the magnetic bodies; and a second insulating housing mounted to the top of the first insulating housing and covered the recess, the magnetic bodies and the terminals being exposed from a top surface of the second insulating housing;

wherein, each of the magnetic bodies is without a magnetic pole before the magnetic bodies are mounted to the printed circuit board;

wherein, each of the magnetic bodies has a predetermined magnetic pole by magnetizing the magnetic bodies after the magnetic bodies are mounted to the printed circuit board.

2. The magnetic connector as claimed in claim 1, further comprising a circuit protection element being soldered on the printed circuit board.

3. The magnetic connector as claimed in claim 2, wherein the magnetic bodies, the terminals and the circuit protection element are soldered on the printed circuit board through a surface mount technology.

4. The magnetic connector as claimed in claim 1, wherein the magnetic bodies are permanent magnets.

5. The magnetic connector as claimed in claim 1, wherein the magnetic bodies are magnetized by one of constant current magnetization and pulsed magnetization.

6. The magnetic connector as claimed in claim 1, wherein a first supporting portion extends from an inner surface of the bottom wall, and the first supporting portion is positioned in the recess, a plurality of protruding portions extend from a peripheral of the inner surface of the bottom wall, and the protruding portions are positioned in the recess, the printed circuit board is supported by the first supporting portion, the printed circuit board is supported by the protruding portions.

7. The magnetic connector as claimed in claim 1, wherein the side wall has opposite long walls and opposite short walls connected between the long walls, a plurality of alignment portions extend from a peripheral of an inner surface of the bottom wall, each of inner surfaces of the long walls of the side wall has one alignment portion, and at least one of inner surfaces of the short walls of the side wall has one alignment portion, the printed circuit board is guided by the alignment portion of the short walls of the side wall.

8. The magnetic connector as claimed in claim 6, wherein the side wall has opposite long walls and opposite short walls connected between the long walls, a plurality of alignment portions extend from the peripheral of the inner surface of the bottom wall, each of inner surfaces of the long walls of the side wall has one alignment portion, and at least one of inner surfaces of the short walls of the side wall has one alignment portion, the printed circuit board is guided by the alignment portion of the short walls of the side wall.

9. The magnetic connector as claimed in claim 7, wherein a top surface of each long wall of the side wall is formed a docking groove, the docking groove is perpendicular to the bottom wall, a plurality of docking portions correspond to the docking grooves, the docking portions extend from a peripheral of a bottom surface of the second insulating housing, the docking portions are inserted into the docking grooves.

10. The magnetic connector as claimed in claim 8, wherein a top surface of each long wall of the side wall is formed a docking groove, the docking groove is perpendicular to the bottom wall, a plurality of docking portions correspond to the docking grooves, the docking portions extend from a peripheral of a bottom surface of the second insulating housing, the docking portions are inserted into the docking grooves.

11. The magnetic connector as claimed in claim 7, wherein a plurality of bumps extend from a top surface of each long wall of the side wall, a plurality of receiving grooves correspond to the bumps of the first insulating housing, the receiving grooves are formed at a peripheral of a bottom surface of the second insulating housing, the bumps are engaged with the receiving grooves.

12. The magnetic connector as claimed in claim 8, wherein a plurality of bumps extend from a top surface of each long wall of the side wall, a plurality of receiving grooves correspond to the bumps of the first insulating housing, the receiving grooves are formed at a peripheral of a bottom surface of the second insulating housing, the bumps are engaged with the receiving grooves.

13. The magnetic connector as claimed in claim 1, wherein the second insulating housing has a plurality of holding portions arranged in a row, each of the holding portions has a hole, the magnetic bodies and the terminals are arranged in the holes respectively.

14. The magnetic connector as claimed in claim 7, wherein the second insulating housing has a plurality of holding portions arranged in a row, each of the holding portions has a hole, the magnetic bodies and the terminals are arranged in the holes respectively.

15. A method of manufacturing a magnetic connector comprising:

providing a first insulating housing and a second insulating housing;

mounting a plurality of magnetic bodies and a plurality of terminals on pads of a printed circuit board;

soldering the magnetic bodies and the terminals on the printed circuit board, and the magnetic bodies being without magnetic pole at this time;

magnetizing the magnetic bodies to have predetermination magnetic poles after the soldering step;

assembling the printed circuit board with the magnetic bodies and the terminals into a recess of the first insulating housing; and assembling the second insulating housing to the first insulating housing to cover the recess.

16. The method as claimed in claim 15, wherein the magnetic bodies are magnetized by one of constant current magnetization and pulsed magnetization.

17. The method as claimed in claim 15, wherein the second insulating housing has a plurality of holding portions arranged in a row, each of the holding portions has a hole, the magnetic bodies and the terminals are arranged in the holes respectively.

18. A method of manufacturing a magnetic connector comprising:

providing a first insulating housing and a second insulating housing;

mounting a plurality of magnetic bodies and a plurality of terminals on pads of a printed circuit board;

soldering the magnetic bodies and the terminals on the printed circuit board, and the magnetic bodies being without magnetic pole at this time;

assembling the printed circuit board with the magnetic bodies and the terminals into a recess of the first insulating housing;

magnetizing the magnetic bodies to have predetermination magnetic poles; and assembling the second insulating housing to the first insulating housing to cover the recess.

19. The method as claimed in claim 18, wherein the magnetic bodies are magnetized by one of constant current magnetization and pulsed magnetization.

20. The method as claimed in claim 18, wherein the second insulating housing has a plurality of holding portions arranged in a row, each of the holding portions has a hole, the magnetic bodies and the terminals are arranged in the holes respectively.

* * * * *